US010406489B2

(12) United States Patent
Volker

(10) Patent No.: US 10,406,489 B2
(45) Date of Patent: Sep. 10, 2019

(54) MIXING UNIT FOR FLUSHING SOLUTIONS

(71) Applicant: Manfred Volker, Blankenbach (DE)

(72) Inventor: Manfred Volker, Blankenbach (DE)

( * ) Notice: Subject to any disclaimer, the term of this patent is extended or adjusted under 35 U.S.C. 154(b) by 483 days.

(21) Appl. No.: 14/950,237

(22) Filed: Nov. 24, 2015

(65) Prior Publication Data

US 2016/0158713 A1 Jun. 9, 2016

(30) Foreign Application Priority Data

Nov. 25, 2014 (DE) ..... 10 2014 017 420

(51) Int. Cl.
*B01F 3/08* (2006.01)
*B08B 3/04* (2006.01)
(Continued)

(52) U.S. Cl.
CPC ..... *B01F 3/088* (2013.01); *B01F 15/00194* (2013.01); *B01F 15/00422* (2013.01); *B01F 15/0205* (2013.01); *B01F 15/0243* (2013.01); *B01F 15/0261* (2013.01); *B08B 3/04* (2013.01); *B08B 9/00* (2013.01); *B08B 9/021* (2013.01); *B08B 9/023* (2013.01); *B08B 9/027* (2013.01); *B08B 9/032* (2013.01); *B08B 9/0321* (2013.01);
(Continued)

(58) Field of Classification Search
CPC .. B01F 3/088; B01F 15/0261; B01F 15/0243; B01F 15/0205; B01F 15/00422; B01F 15/00194; B01F 2003/0896; B08B 9/032; B08B 9/0321; B08B 3/04; B08B 9/027; B08B 9/023; B08B 9/021; B08B 9/00; B08B 3/10; B08B 3/08
USPC ..... 366/141, 182.3
See application file for complete search history.

(56) References Cited

U.S. PATENT DOCUMENTS 6,096,007 A 8/2000 Haan et al.
6,471,855 B1 * 10/2002 Odak ..... A61M 1/3693 210/134
(Continued)

FOREIGN PATENT DOCUMENTS

DE 1955538 12/1966
DE 3315031 A1 1/1985
(Continued)

OTHER PUBLICATIONS

WO 2008135323 Claims Espacenet Machine Translation.*

*Primary Examiner* — Walter D. Griffin
*Assistant Examiner* — Shuyi S. Liu
(74) *Attorney, Agent, or Firm* — Greer, Burns & Crain, Ltd.

(57) ABSTRACT

A mixing unit for ready-to-use flushing solutions with a mixing chamber, with which conduits for ultrapure water and for concentrate communicate, in order to form a ready-to use flushing solution therein is characterized in that the concentrate is filled into a concentrate bag, which is provided with a concentrate bag connector, which is connectable to a connector on the mixing unit, that the connector on the mixing unit is covered by a pivotal concentrate valve in its closed state so that a sealed flushing space is defined around the connector and that a flushing liquid conduit communicates with the connector on the mixing unit so that flushing liquid is conveyable into the flushing space, which can completely clean the connector internally and externally.

9 Claims, 5 Drawing Sheets

(51) Int. Cl.

| | |
|---|---|
| ***B08B 9/00*** | (2006.01) |
| ***B08B 9/02*** | (2006.01) |
| ***B08B 9/023*** | (2006.01) |
| ***B08B 9/027*** | (2006.01) |
| ***B08B 9/032*** | (2006.01) |
| ***B01F 15/00*** | (2006.01) |
| ***B01F 15/02*** | (2006.01) |
| ***B08B 3/08*** | (2006.01) |
| ***B08B 3/10*** | (2006.01) |

(52) U.S. Cl.
CPC ..... *B01F 2003/0896* (2013.01); *B08B 3/08* (2013.01); *B08B 3/10* (2013.01)

(56) References Cited

U.S. PATENT DOCUMENTS

| | | | | |
|---|---|---|---|---|
| 7,635,359 | B2 | 12/2009 | Nakazawa et al. | |
| 2005/0171501 | A1* | 8/2005 | Kelly | A61M 1/3462 604/500 |
| 2006/0270971 | A1* | 11/2006 | Gelfand | A61B 5/201 604/66 |
| 2011/0042202 | A1 | 2/2011 | Pettee et al. | |
| 2014/0091022 | A1* | 4/2014 | Raiford | A61M 1/1656 210/137 |
| 2015/0305819 | A1* | 10/2015 | Krause | A61B 90/70 134/8 |

FOREIGN PATENT DOCUMENTS

| | | | | |
|---|---|---|---|---|
| DE | 4121568 | A1 | 10/1992 | |
| DE | 4122171 | A1 | 1/1993 | |
| DE | 4137748 | A1 | 5/1993 | |
| DE | 4332070 | A1 | 3/1995 | |
| DE | 4405831 | A1 * | 8/1995 | A62B 17/00234 |
| DE | 69318988 | T2 | 3/1996 | |
| DE | 19538818 | | 4/1997 | |
| DE | 19733278 | A1 | 2/1999 | |
| DE | 102009057562 | A1 | 6/2011 | |
| DE | 102010055781 | A1 | 6/2012 | |
| DE | 102011102662 | A1 | 11/2012 | |
| DE | 102012001879 | A1 | 8/2013 | |
| EP | 1514575 | A1 * | 3/2005 | A61M 39/16 |
| EP | 2689790 | | 7/2012 | |
| EP | 2674399 | | 12/2013 | |
| WO | 2005077335 | A1 | 8/2005 | |
| WO | WO 2008135323 | A1 * | 11/2008 | A01J 7/027 |

* cited by examiner

MIXING UNIT FOR FLUSHING SOLUTIONS

Field of the Invention

The subject application relates to medical flushing solutions, and more particularly to a mixing unit for flushing solutions.

Summary of the Invention

The object of this development is the economical preparation, storage and mobile administration of flushing solutions by using Purisol, Ringer's and common salt concentrates, which are mixed with a chemically and microbiologically ultrapure liquid prepared in situ to form ready-to-use flushing solutions for surgical operations, e.g. gynaecology, urology and arthroscopy.

A mobile liquid store, which is equipped with a sterile disposable item, enables precise volumetric determination and sterile removal and simple and economical usage and administration.

The use of this development for other fields, such as general surgery, veterinary medicine, in the laboratory or in biology and pharmacy as an ultrapure flushing liquid or as a starting medium for the production of medicines, cell cultures and the like is conceivable and practicable.

Flushing solutions are generally processed from distilled water constituting the base material which is produced centrally, in a central production process to form flushing solutions and transported with considerable logistical cost to the place of use.

For medicinal use, industrially produced flushing solutions, for instance, in volumes of 3 l, 5 l, 10 l are made available to hospitals and are temporarily or permanently stored with large in-house, logistical staff input.

These bag volumes are not sufficient for the duration of the operation or examination, for instance with a bladder operation with ca. 60 l flushing liquid, so that a reserve must be available outside the central operation region in order to prepare, heat and provide the bag.

The administration is effected in part gravimetrically or with bag pressure sleeves. Expensive disposable items, such as pump segments or for the bag heater are additionally often necessary. A considerable disadvantage, e.g. with endoscopic examinations, is the lack of visibility as a result of floating tissue or pulsating flushing liquid because, for instance, the necessary flushing liquid pressure is not maintained constant between 0.1 bar to 0.3 bar.

Flushing mush be performed liberally in order to improve the wound hygiene. This results in staff and material costs.

The regulatory and normative requirements on the quality of the basic material, namely water, are so high that it was previously not possible to produce the verifiable, medicinal flushing solutions, when required, in situ, e.g. in a hospital. It is, on the one hand, the high microbiological requirements and, on the other hand, the necessary chemical requirements as regards the basic material, namely water, which work against any verifiable and detectable, normatively required quality of the in situ production controlled by requirements.

The decentralised production of medicinal flushing solutions by hospital personnel requires reliable procedures both in the operation and also in the reliability of the technology as regards the flushing solution quality.

The object of the invention are necessary improvements and therefore the economical, user-friendly in situ production of a flushing solution with low staff input and a flushing volume which corresponds to the examination or a number of operations.

The storage, long term stability and as low as possible a volume of the concentrates assumes a particular significance. Further requirements are uninterrupted administration without additional effort by the staff whilst maintaining the use temperature and hygiene of the solution.

A space-saving technique for producing, the flushing solution and a mobile flushing solution container are to be employed, which includes the important components for high hygiene, reliability, simple operation and a constant flow and pressure for administering the flushing liquid.

Residues should be disposed of as simply as possible.

High availability of the devices for all measuring and monitoring tasks as regards their intrinsic safety and only a remote probability of failure is important in order to avoid a catastrophic impact on the patient or to correctly monitor the quality or toxicity of the liquid produced within the warranted acceptance criteria.

This object is solved effectively by the invention if, to produce the flushing solution, the combination of a reverse osmosis membrane and two further filter stages, for instance ultrafilters or Sterifilters, preferably in the form of capillary membranes, is used. This filter combination and further components will be referred to below as a filling station.

In order to produce, for instance, ca. 60 l ready-to-use Purisol solution, ca. 56 l sterile filtered permeate should be proportionally diluted or mixed with ca. 3.6 l high concentration Purisol concentrate so that the flushing solution which is produced can be used without further tests for intra-operative and post-operative bladder flushing.

For Purisol concentrates, a formulation is required in a final dilution of 27.0 g sorbitol and 5.4 g mannitol per 1 liter ultrapure liquid. In practice, a tolerance range of 25.65-28.35 g sorbitol and 5.13-5.67 g mannitol plus ca. 1 liter liquid is acceptable.

By experiments and tests, with a concentrate volume of 1 l the sorbitol concentration was raised to ca. 443.6 g and the mannitol concentration to ca. 88.7 g with a liquid volume of ca. 648.7 g to a concentration factor of ca. 16.43 and a density of ca. 11806 g/cm$^3$ (20° C.)

A concentrate volume of ca. 3652 l+56.38 l ultrapure liquid results in ca. 60 l ready-to-use Purisol flushing solution. This concentrate then contains ca. 1620 g sorbitol, ca. 324 g mannitol and ca. 2369 g liquid.

The solubility of the substances in the production of the concentrate and a lasting solution of the same without precipitation at low temperatures, e.g. 5° C., suggest the concentration factor of ca. 16-17 times as a result of tests.

The aforementioned flushing solution can be used in place of e.g. Ringer's solutions and/or other sodium chloride solutions, which can be used, in particular, in the field of surgery and also in other medicinal or mentioned fields. The concentrates and their mixing ratios should be adapted to the particular uses.

E.g. 0.9% sodium chloride solutions are frequently used as a flushing solution. In order to prepare ca. 100 l of this solution, a concentrate volume of ca. 2.9 l is sufficient at a ratio of 1:35. Ringer's flushing solutions may be produced with slight variations from the aforesaid. For instance, with a mixing ratio of 1:34.6, 100l Ringer's solution may be prepared with ca. 2.872 l Ringer's concentrate. The increase in concentration to ca. 30-35 times with a solubility temperature of ca. 10° C. shows the potential for logistical, handling and space savings.

The described method and the components and volumes used are, however, not reduced thereto. Determined by the ultrapure active agent and the precise mixing and diluting, a large spectrum of flushing solutions may be produced.

As a result of the high concentration, the growth of microbes in the concentrate is advantageously nearly prevented.

In order to prepare the flushing solution, the concentrate container, which is advantageously constructed in the form of a bag, is suspended on prepared mountings on the filling station concentrate scales and the mixing process initiated. The scales are initially verified by the known bag weight.

The connections on the filling station for the concentrate and also for the flushing solution bag which is yet to be described, are effected by the user at self-cleaning connectors free from risk of confusion on the filling station, which are constructed in this application, for instance, in the form of valve solutions, but can also be constructed on the device in the form of flexible conduits.

A mobile flushing solution container, which is preferably constructed in the form of a pressure container, is equipped with great advantage with an insertable, sterile flushing liquid bag, which is filled with an appropriately large volume.

The flushing solution bag includes a permanent connector, which can be pushed through the lockable cover of the pressure container and fixed in position. The connector can be provided with flexible hose conduits which continue on and are constructed in the form of filling or transfer conduits. The connector can advantageously be constructed in the form of only one hose, which is to be used selectively and, in dependence on the sterility requirements, both as a filling hose and also as a transfer hose.

For the purpose of administering the flushing liquid at the place of use, a transfer system, for instance with an endoscopy system, can be connected to the transfer connection of the flushing solution connector. A connection to other systems conventional in surgery, for instance to flushing-suction systems, is also practicable and possible.

The object of simple operation and administration with constant flushing flow and pressure is solved by the introduction of compressed gas (air) either preferably into the pressure container or also selectively directly into the flushing liquid bag.

The control and monitoring of the compressed gas is advantageously arranged within the mobile flushing solution container. The production and supply of the compressed gas can be produced, for instance, by an on-site source or by the device.

The proportioning of the concentrate and permeate is effected by means of a concentrate scales and a flushing solution container scales, whereby the concentrate scales in the filling station is verified each time the filled concentrate container is attached.

For this purpose, the mobile flushing solution container advantageously also includes a scales, which monitors the filling state and should automatically be tested for security reasons by means of a reference weight.

For the purpose of homogenising and tempering, ultrapure or nearly sterile permeate is heated and mixed with concentrate added in a metered amount in a mixing block.

Before introduction into a sterile flushing solution container/bag, a second sterile filtration of the mixed solution is effected. The cleaning of the system or prevention and reduction of microbes is performed by the combination of a disinfecting and cleaning agent, which is of low toxicity and based on citrate, with a water heating. Both the primary and also the secondary side of the reverse osmosis should be disinfected or cleaned separately from one another by means of an additional pump, also without transmembrane flow.

All process-relevant data are in principle gathered by the operational computer and also the safety computer and optionally processed. The measurement results are sent from the operational computer to the safety computer and vice versa. Each computer compares the measurement results with its own and sends back a confirmation.

After the confirmation from the operational and safety computers, the data are written together with a check total into the trend data store, which can preferably be constructed in the form of an Eprom but also as another storage medium.

The electronic system of the mobile flushing solution container can be operated by means of a rechargeable accumulator and all necessary parameters and also their deviations, such as weight, temperature and container, pressure, are indicated on the indicator of the mobile flushing solution container.

By establishing a wireless data exchange between the filling station and mobile flushing solution container there is, for instance, the monitoring of the filling, the proportionality and the temperature.

Further details and advantages are described in the figures described below.

Detailed Description of Preferred Emobidments

Figures 1A, 1B:
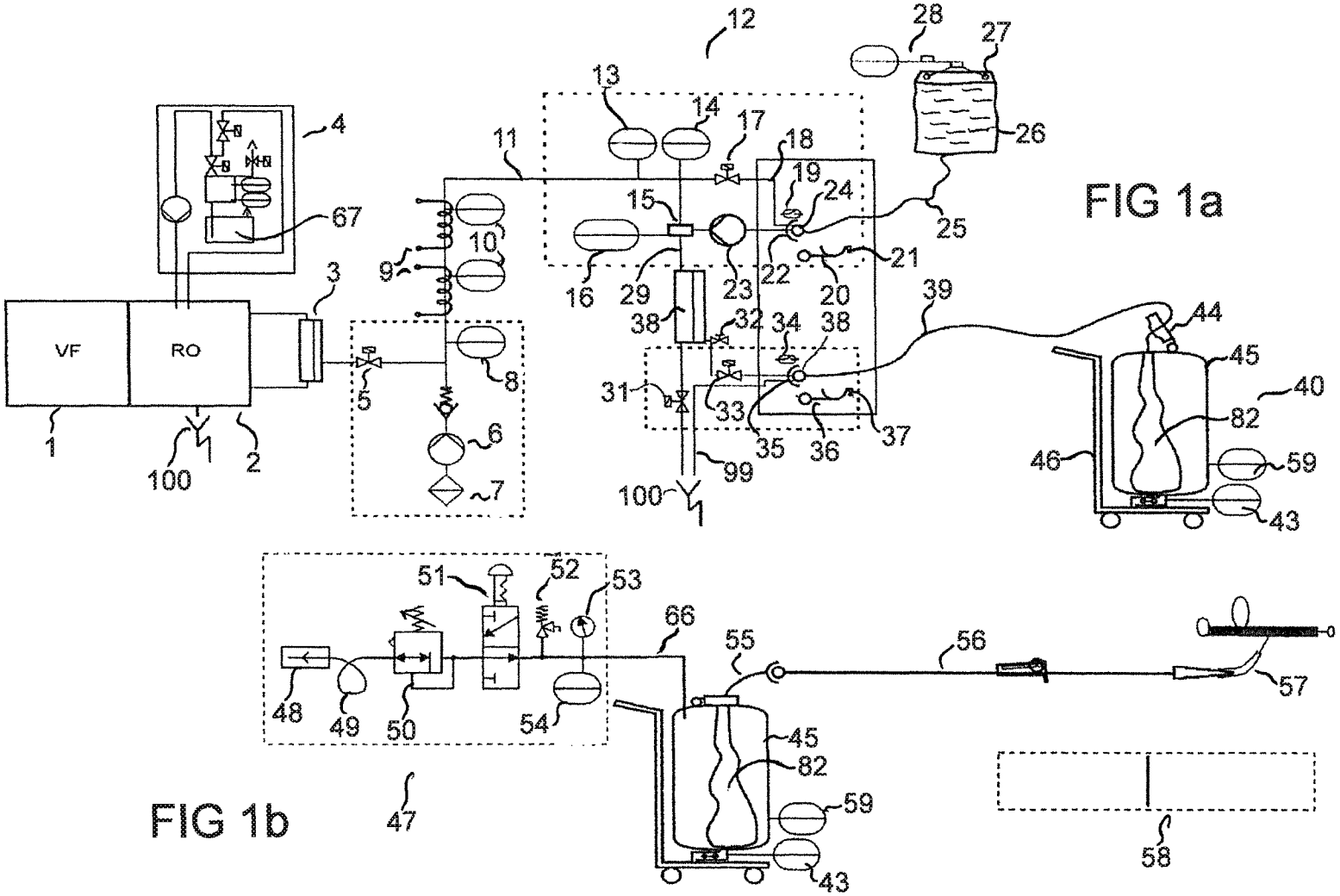
FIG. 1*a* is a schematic view of flush fluid preparation system.
FIG. 1*b* is a schematic view of a possible transfer of flush fluid to an endoscopic system.

FIG. 1 shows the entire preparation up to usage. The liquid to be prepared can be conducted, for instance via an optional prefilter (1), which can be constructed in the form of particle stages and/or further filter stages to eliminate hardness, chemicals and chlorine, to the RO installation (2). In order to eliminate microbiological contamination, the RO (2) includes, for instance, a disinfection unit (4), with which, without the assistance of the user, chemico-thermal disinfection may be performed. Canister (67) contains the disinfecting/cleaning agent, which is advantageously used in the form of a citrate-containing solution. The further function of device (4) may be derived from the drawing and will not be described here in more detail. There is of course the possibility of hot cleaning the RO installation without using further disinfecting agent. The permeate produced by the RO installation (2) is circulated via the primary side of the filter (3). The permeate released by the RO control (58) by means of a conductivity meter, which is not shown, flows to the secondary side of the filter (3) and via permeate release valve (5) to the mixing unit (12). Permeate potentially already pre-heated by the RO installation (2) is heated by means of heater (9) and temperature controller (8, 13) to the necessary flushing liquid temperature. The permeate is fed via conduit (11) to a mixing chamber (15), into which concentrate is fed by means of pump (23) from bag (26) and conduit (25) to the connector (24) and connector (22) on the device. During this, the concentrate valve (20) is open. Detector (19) indicates "open" because magnet (21) has exceeded the required distance. The concentrate flushing valve (17) is only opened when valve (20) is closed and with appropriately selected or preset flushing programs in order to clean the connector (22). Concentrate bag (26) is suspended with its suspension means (27) in appropriate hooks on the concentrate bag scales (28). The known bag weight serves to verify the scales. The second conductivity and temperature meter (16) detects the corresponding values for reasons of redundancy. The flushing liquid, which is tempered and homogeneously mixed by chamber (15), flows via conduit (29) to a second Sterifilter (30). Defective flushing liquid is discarded via bypass valve (31) to the discharge (100). When valve (31) is closed and flushing solution release valve (33) is open, the flushing liquid is conducted via the flushing solution connector (35) on the device, the bag connector (38) connected thereto and conduit (39) to the mobile flushing solution container (40), inserted within which is a sterile flushing solution bag (82). There is the possibility of removing a sample amount of flushing solution at sample removal point (32). The mobile flushing solution container includes a scales (43), which registers the current filling level or the weight of the flushing volume. A temperature sensor (59) is also mounted so that the flushing liquid temperature may be indirectly measured.

When the flushing solution valve (36) is closed and an appropriate flushing program is selected and initiated, the connector on the device is flushed or disinfected with sterile liquid or cleaning solution via flushing outlet (99). The test of the filters (3/30) is effected with valves (20/36) closed by supplying filtered air by means of air pump (6) and can apply air selectively, by valve switching, to the secondary side of the filter (3) or the primary side of the filter (30). The liquid is thereby partially displaced by the air. Due to the hydrophilic character of the filter membrane, when the filter characteristic is intact only a very small pressure drop will occur, which can be registered or monitored by means of pressure sensor (14) and electronic system (58). As a result of this test, both the filters (3/30) and also the fluid tightness of the valves (20, 36) can be verified or checked. Also shown schematically in FIG. 1 is a possible transfer of the flushing liquid to an endoscopic system (57). Compressed air connector (48) can be connected by means of flexible hoses (49) to an on-site compressed gas source. In order to ensure a constant flow of flushing liquid, the pressure control unit (47) includes an adjustable pressure controller (50), an emergency stop with a mushroom button and forced ventilator (51), a manual pressure limiting valve (52), a manometer indicator (53) and an electronic pressure sensor (54), which, like all sensors and actuators, can be analysed by means of redundant electronic system (58) and displayed. The low pressure control valve (50) is adjustable. The pressure control unit (47) can be designed for a control range of 0 to 0.5 bar and is set for practical use to a delivery pressure of 0.3 bar, for instance with prostate operations. The air controlled in this manner is fed via hose connection (66) into pressure container (45). The flushing liquid in bag (82) is conveyed by the supplied pressure via transfer connection (55) and a suitable transfer system (56) to the endoscopic system (57).

It will be understood that units other than endoscopic systems, such as the flushing suction systems conventional in surgery, are also connectable to system (56).

It is observed additionally that a further Sterifilter, which is not shown here, would be connectable to conduit (56).

There would also be the possibility of introducing the controlled compressed gas medium directly into the flushing solution bag (41) or conducting the transfer via a pump with a disposable hose segment.

Figure 2A:
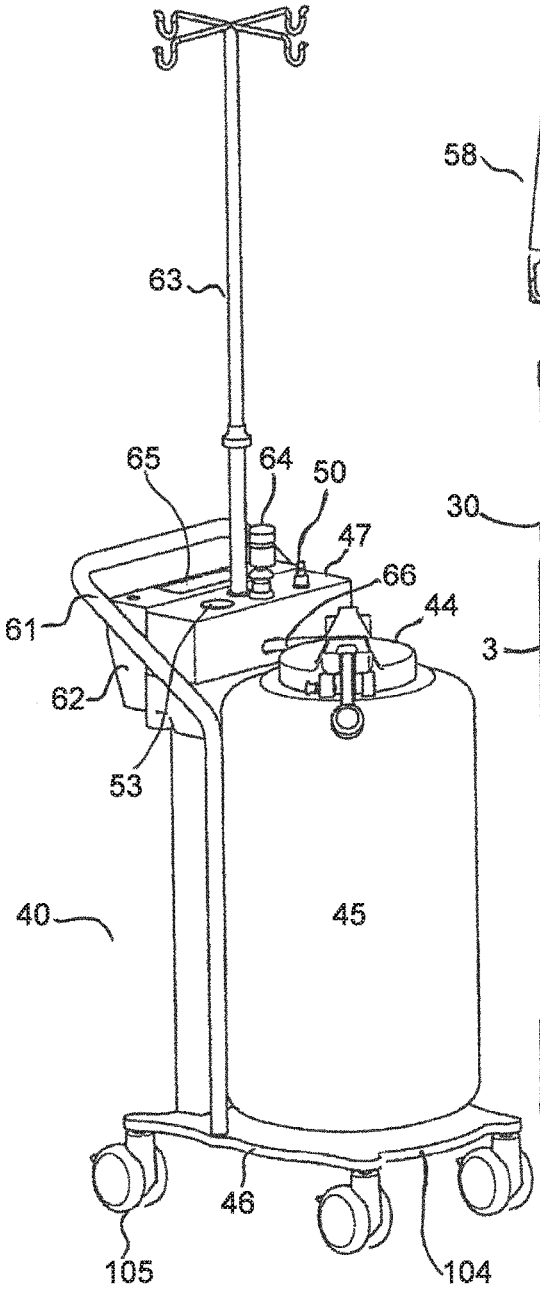
FIG. 2*a* is a view of a mobile flush solution container.
Figure 2B:
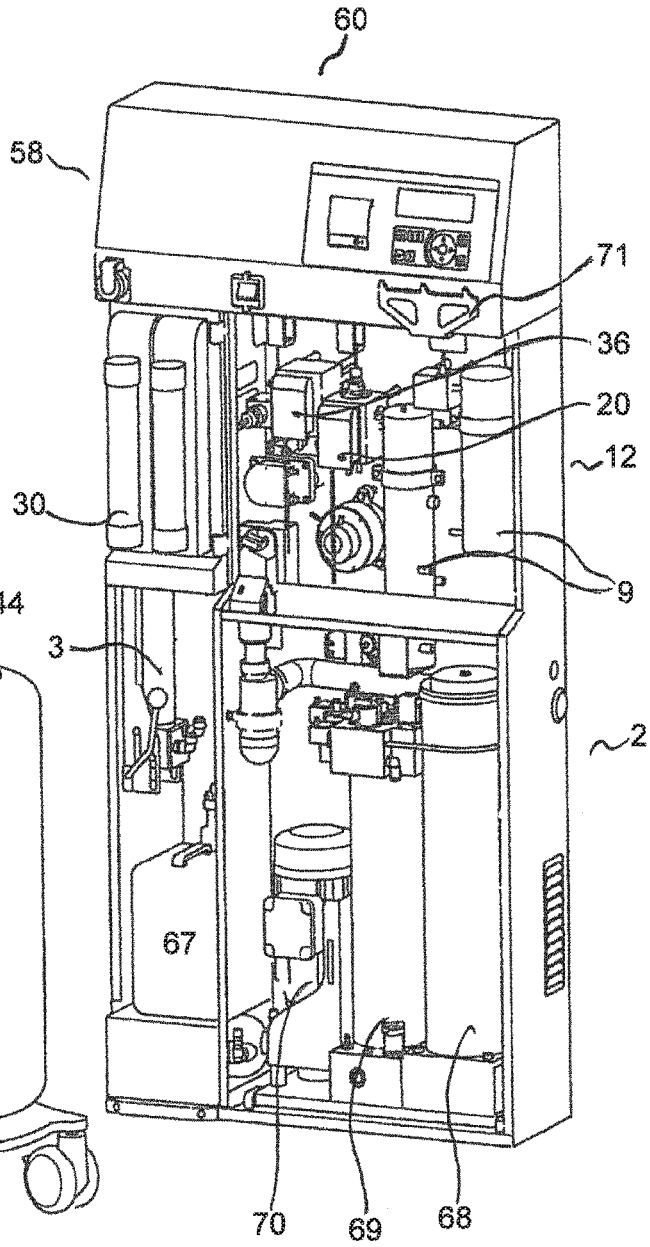
FIG. 2*b* is a view of a filling station.

FIG. 2 illustrates spatially the entire unit of a mixing installation or filling station. As a result of the assumed spatially limited conditions in hospitals, the filling station (60) was constructed as flat as possible in order not to encroach upon the passages in corridors or in premises. This necessitates a vertical construction of the RO installation (2) with membranes (68), feed tank (69) and pumps (70). A cleaning canister (67) is also shown. The mixing unit (12) is attached via the RO installation, whereby reference is made in this drawing merely to the position of the concentrate valve (20), the flushing solution valve (36), the heater (9) and the Sterifilter (30) in order to illustrate the mechanical handling. The valves are shown here in the closed state. Concentrate bag scales (28) is mounted below the electronic system (58) and shown in the form of an arm (71) with mounting hooks for the concentrate bag. The installation is effected flush with the wall at a suitable position with an appropriate vertical spacing from the floor in order to ensure communication, as will be explained below, and cleaning.

The mobile flushing solution container (40) consists of a transport carriage (46) with a puffing and pushing handle (61), the pressure container (45), a cover (44) and an infusion rod (63). Components of the mobile flushing solution container (40) are a pressure control unit (47), whose outlet communicates directly via a flexible hose connection (66) with the pressure container (45), and an electronic system (62) with a communication indicator (65), for instance for indicating the filling level, the temperature, compressed air and other relevant values and an indicating signal light (64).

The communication between the flushing solution container (40) and the filling station (60) is effected wirelessly by means of sensors in the roller region below the base plate (104) of the transport carriage (40).

The detection of the parking and docking positions of the flushing solution container (40) at the filling station (60) is predetermined by the position of the preferably infrared sensors.

Mounted on the filling station at the same level is a corresponding sensor. The docking angle and position at the filling station may thus be influenced by selection and position of the sensors.

The further components are explained in part by the drawing or will be described later. It will be clear that the construction of the components is of space-saving type and their arrangement can differ from that illustrated and is also possible in other embodiments. Reference is also not made in all points to the labelling.

Figure 3A:
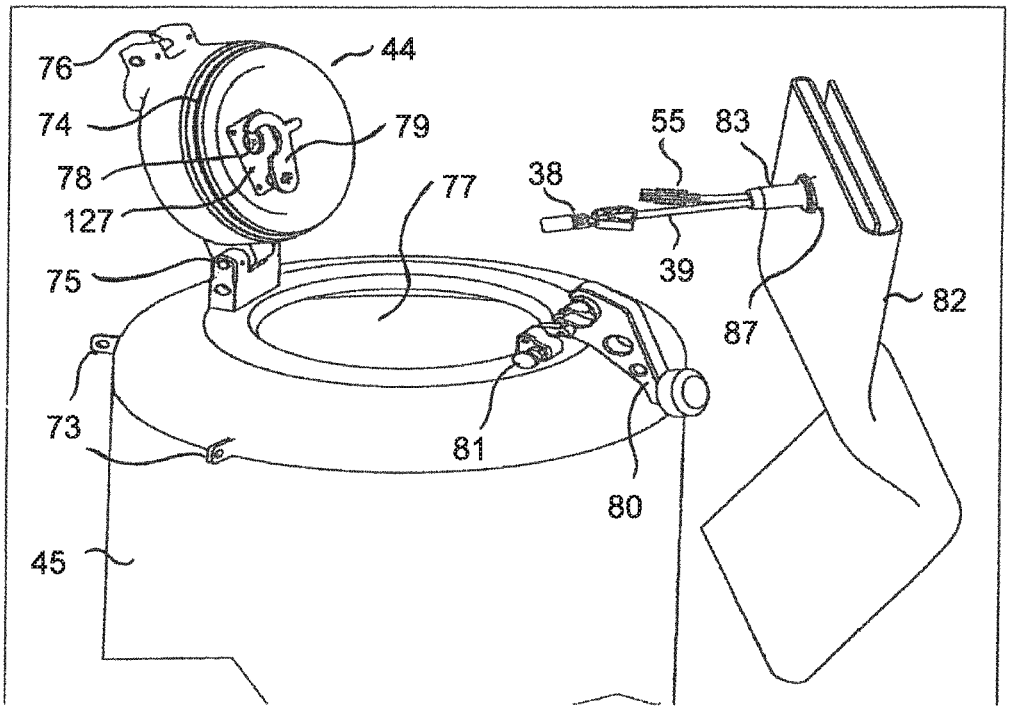
FIG. 3*a* is a view of a pressurized container with an open lid.
Figure 3B:
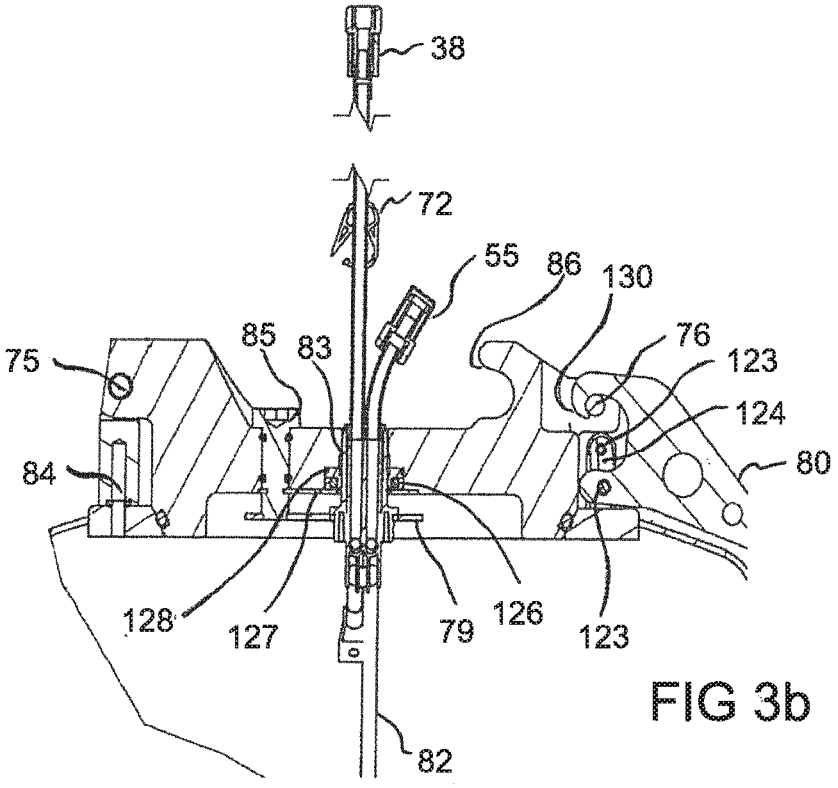
FIG. 3*b* is a partial cross-sectional view of the container with the lid closed.

FIG. 3 schematically shows the pressure container (45) with cover (44) open and a connector mounting (78), through which the cylindrical bag connector (83) is pushed and is retained by means of movable connector lock (79) and retaining groove (87). In order that a form-locking seal with good sliding properties between connector (83) and connector mounting seal (78) can occur, seal (78) preferably consists of a Teflon insert (128), which is pressed with an O-ring (126) and a pressure plate (127) against connector (83) so that the aforementioned objects are achieved. A form-locking and sealing connection of the cover (44) to the pressure container (45) is produced in the closed state on the one hand by cover seal (74) and the conical sealing mount (77) in the pressure container opening. For the purpose of sealing, hook (126) pulls the cover lock (76) by means of locking handle (80) into position. Locking fastener (81) locks behind the rotary joint (124). Cover clamping hinge (75) holds cover (44) in the open state in the upright position.

It will be understood that the bag (41/82) is to be inserted into the container. Two lateral guides (73) are attached to the pressure container (45) for the purpose of vertical support. The compressed air supply (66) is attached, for instance, in the hinge region (75) by means of connector (84). Connector lock (79) may be opened in the event of a defect from the exterior by means of rotary shaft (85). Also shown in this figure is the filling conduit (39) with connector (38), which is to be connected in the filling process to connector (35). After the filling process, clamp (72) can be closed. In order to differentiate between the filling conduit (39) and transfer conduit (55), these are equipped with different connectors and constructed in different lengths, as shown.

Figure 4A:
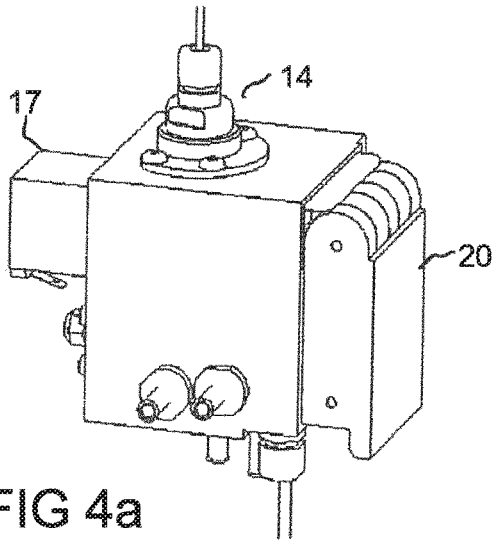
FIG. 4*a* is a perspective view of a concentrate valve.
Figure 4B:
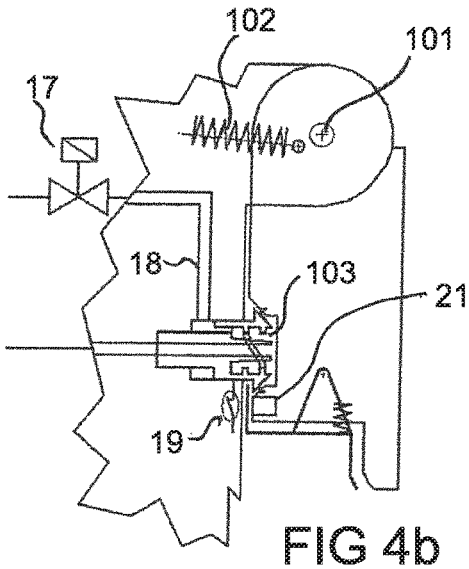
FIG. 4*b* is a schematic cross-sectional view of the concentrate valve in a closed position.
Figure 4C:
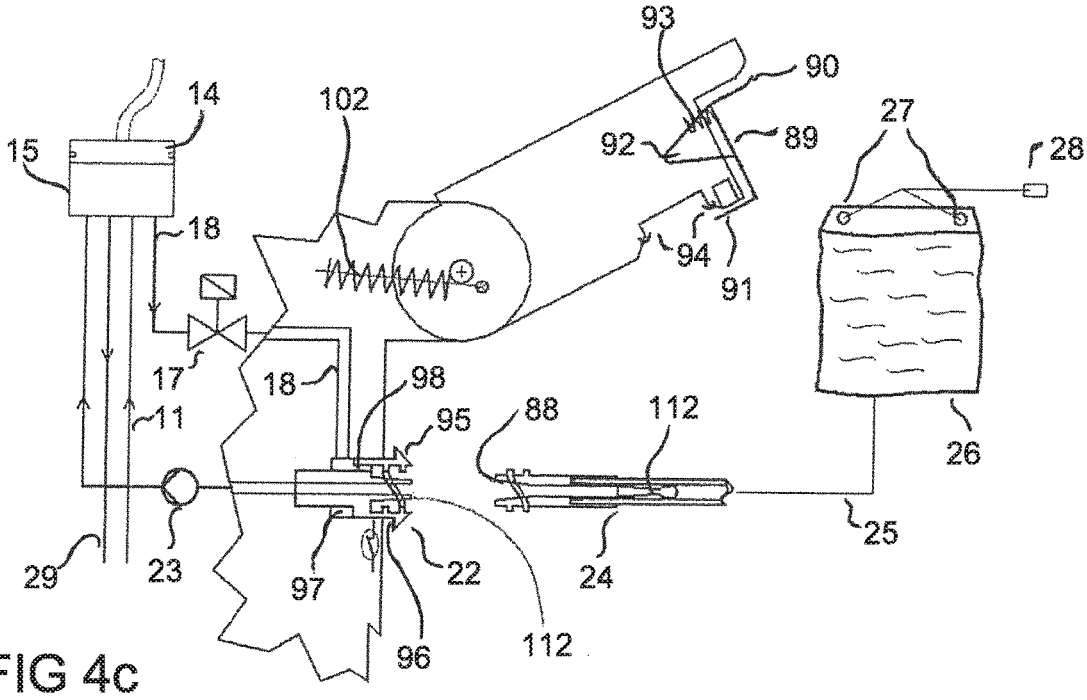
FIG. 4*c* is a schematic cross-sectional view of the concentrate valve in an open position.

FIG. 4 is a schematic, perspective view of the concentrate valve (20), the opening, closing, and lifting and cleaning process of which will be described as follows. Situated in the valve (206) there is a magnet (21), which activates a magnetic contact (19) when the valve is closed. For the purpose of flushing, the valve (20) is closed so that the valve locking hook (91) of the valve lock (89) engages in the locking flange (96) of the connector (22). By pushing back the lock (89) over pivot (92) by means of valve locking handle (90), the lock spring (93) is compressed and the valve locking hook (91) thus enables the lifting process of a valve (20). The valve pivots upwardly. This is promoted by lifting spring (102), which engages laterally, of the pivot point (101). In order to completely flush the connector (22), the seal (94) presses, when the valve is closed, in a form locking manner against the outer cone (95) of the connector (22) and thus seals the flushing space (103).

When the flushing valve (17) is open, liquid flows via conduit (18) into a rear annular gap (97) in the connector (22) and from there through flushing bores at the periphery to the flushing space (103). When the pump (23) is running, the connector (22) is completely cleaned internally and externally and, after the cleaning process, can be cleared of liquid residues during the pressure holding test.

When the valve (22) is open, the concentrate connection (24), which is equipped, for instance, in the form of a female connector with an inner cone 1/18 and a two-start external screw thread 10×6, into which concentrate bag connector (22) with the corresponding cones and screw threads is screwed in. The frangible cone (112) should be broken. A form-locking, sealing connection, for instance by the inner and outer cones and the screw thread is ensured in the coupled state. The supply of the permeate via conduit (11) into mixing chamber (15) and of the concentrate via pump (23) is illustrated schematically. The mixed flushing solution is led away via conduit (29). In order to produce the appropriate homogeneity, the conduit feeds occur tangentially or in a suitable manner.

In order to rule out the risk of confusion for the usage, the technical format of the flushing solution connections is constructed differently to that of the concentrate connections.

Figure 5A:
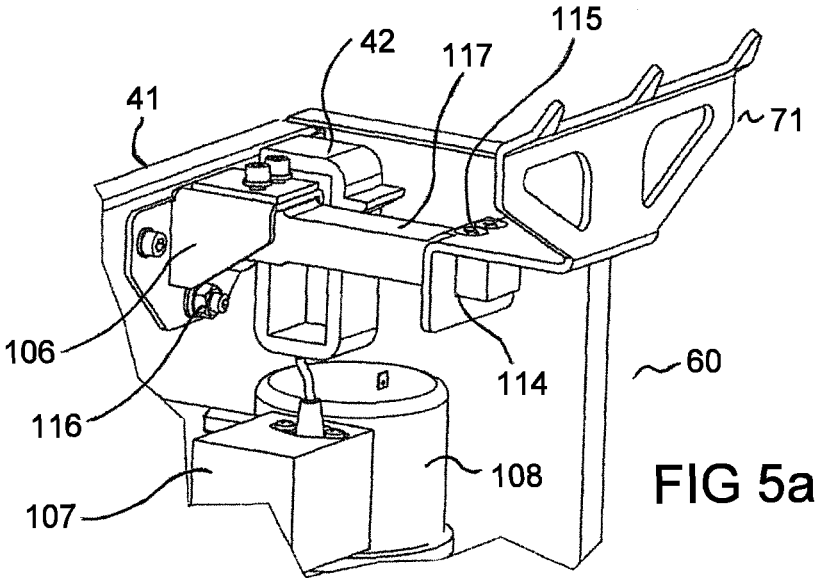
FIG. 5*a* is a perspective view of a container filling station.
Figure 5B:
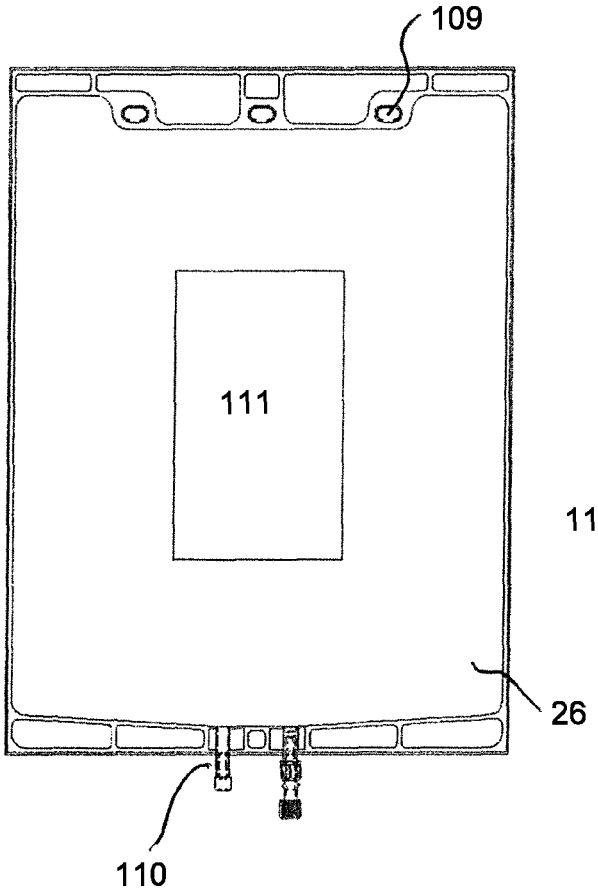
FIG. 5*b* is a schematic view of a concentrate bag.
Figure 5C:
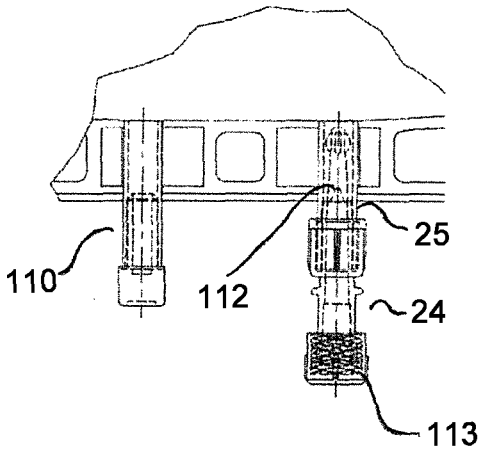
FIG. 5*c* is a detailed view of the concentrate bag connectors.

FIG. 5 schematically illustrates the concentrate bag (26), which consists of a toxicologically safe material, preferably PE film. The bag (26) has a rectangular, welded contour. The bag contents of ca. 1-5 liters can cover the concentrates which are common in surgery and their formulations for producing the required flushing solution. For the purpose of connecting to the connector (22) on the device, the connecting hose (25) can be constructed in different lengths. Bag (26) is suspended with its suspension openings (109) in the arm (71). Arm (71) has a z-shaped bend and for the purpose of stiffening and a form-locking connection with opening (114), is fastened by means of screws (115) to strain gauge beam (99). It will be understood that at the beginning of the mixing process sterile protective cap 13) is to be removed and frangible cone (112) is to be broken. Filling connection (11) is welded. The rear end of the strain gauge beam (99) is screwed to a support arm (106) which, for its part, is adjustably connected to the rear wall (41) of the filling station (60) by means of setscrew (116).

LEGENDS

1. Prefilter
2. RO installation
3. Permeate ultrafilter/Sterifilter
4. Disinfecting unit
5. Permeate release valve
6. Compressed air supply, air pump
7. Air suction filter
8. Temperature controller
9. Hot mixing circuit
10. Over-temperature protector
11. Permeate supply conduit
12. Mixing unit
13. Temperature controller/indicator
14. Pressure sensor
15. Mixing chamber
16. Redundant conductivity meter/temperature indicator
17. Concentrate flushing valve
18. Flushing conduit
19. Concentrate valve detector
20. Concentrate valve
21. Magnet
22. Concentrate bag connector on the device with a two-start internal screw thread and internal outer cone
23. Concentrate pump
24. Concentrate bag connector with frangible cone with a two-start external screw thread and inner cone
25. Concentrate bag connector hose
26. Concentrate bag
27. Concentrate bag suspension
28. Concentrate bag scales
29. Flushing solution conduit
30. Sterifilter 2
31. Flushing solution bypass valve
32. Sample removal point
33. Flushing solution release valve
34. Flushing solution valve detector
35. Flushing solution connector on the device with an inner cone and two-start external screw thread
36. Flushing solution valve
37. Magnet
38. Flushing solution bag connector with outer cone and internal screw thread
39. Flushing solution filling conduit
40. Mobile flushing solution container
41. Filling station rear wall
42. Cable channel
43. Flushing solution container scales
44. Cover
45. Pressure container
48. Transport carriage
47. Pressure control unit
48. Compressed air connector -continued 49. Hose extension
50. Pressure controller
51. Emergency stop
52. Pressure limiting valve
53. Pressure nanometer
54. Pressure sensor
55. Transfer connector with two-start external screw thread, inner cone and closure cap
56. Transfer system
57. Operation usage
58. Electronic system
59. Temperature sensor
60. Filling station
61. Pulling and sliding handle
62. Electronic system for transport carriage
63. Infusion rod
64. Indicating signal light
65. Communication indicator for pressure, temperature, filling level
66. Compressed air hose connection
67. Disinfecting/cleaning agent canister
68. RO membrane
69. Feed tank
70. Pump with drive
71. Concentrate weighing arm with bag suspension hooks
72. Hose clamp
73. Pressure container lateral guide
74. Cover seal
75. Cover clamping hinge
76. Cover lock
77. Pressure container opening with conical sealing mount
78. Connector mounting with inner, pre-stressed sliding seal
79. Connector lock
80. Locking handle with hook
81. Locking fastener
82. Flushing solution bag
83. Bag connector
84. Compressed air supply
85. Rotary locking shaft with outer hexagonal socket
86. Lifting handle
87. Retaining groove
88. Concentrate connector inner cone
89. Valve lock
90. Valve locking handle
91. Valve locking hook
92. Valve locking pivot
93. Valve locking spring
94. Valve seal
95. Seal counter surface
96. Locking flange
97. Flushing flow annular gap
98. Peripheral flushing bores
99. Flushing outlet
100. Discharge
101. Concentrate valve rotary shaft
102. Lifting spring
103. Flushing space
104. Mobile flushing solution container base plate
105. Rollers
106. Arm fastening for weighing cell
107. Mounting block for permeate conductivity sensor
108. Hot permeate circuit
109. Suspension openings
110. Filling container
111. Marking
112. Frangible cone
113. Sterile cap
114. Opening
115. Screws
116. Set screw
117. Strain gauge beam weighing cell
118.
119.
120.
121.
122.
123. Pivot for rotary joint
124. Rotary joint
125. Phase rotary joint
126. O-ring -continued 127. Pressure plate
128. Teflon insert
129.
130. Locking handle hook

The invention claimed is:

1. A mixing unit for ready-to-use flushing solutions, the mixing unit containing a mixing chamber, with which conduits for ultrapure water and concentrate communicate, in order to form a ready-to-use flushing solution therein, the mixing unit comprising:

a concentrate bag which contains concentrate, the concentrate bag being connected to a concentrate bag scales, wherein the concentrate bag is suspended in an arm of said concentrate bag scales, a concentrate bag link connector which is connectable to a link connector of the mixing unit, the concentrate bag link connector being connected to a conduit leading to the mixing chamber, the mixing unit being equipped with a pump, and a swiveling flap disposed in pivoting relation with respect to the link connector of the mixing unit such that, when the first end of the link connector of the mixing unit and the end of the link connector of the concentrate bag are not connected to one another, the flap can pivot between an open state, wherein the first end of the link connector of the mixing unit is exposed, and a closed state covering an opening at the first end of the link connector of the mixing unit wherein the first end of the link connector of the mixing unit is closed, wherein the flap is configured such that when the flap is in the closed state, a flushing area is defined that extends between the flap and the opening of the link connector of the mixing unit, and further extends between the flap and an outer portion of the first end of the link connector of the mixing unit, wherein the flushing area is sealed, and wherein a flushing fluid line, which is equipped with a flushing valve, leads into a rear annular gap in the link connector of the mixing unit and from there through flushing bores at a periphery of the link connector of the mixing unit to the flushing area wherein the flushing fluid line discharges into the flushing area in such a way that flushing fluid can clean the link connector of the mixing unit on the inside and outside, while the pump is running.

2. The mixing unit according to claim 1, wherein the concentrate bag consists of a toxicologically safe material.

3. The mixing unit according to claim 2, wherein the material is a PE film.

4. The mixing unit according to claim 1, wherein the concentrate bag connector includes an external screw thread and an inner cone, and wherein the connector on the mixing unit includes an internal screw thread matching the external screw thread and an outer cone matching the inner cone.

5. The mixing unit according to claim 1, wherein the concentrate bag connector includes a frangible cone.

6. The mixing unit according to claim 1, wherein the concentrate bag further includes a filling connection for the concentrate.

7. The mixing unit according to claim 1, further comprising a concentrate pump, which supplies concentrate to the mixing chamber matched to measured values from the concentrate bag scales and a flushing solution container scales.

8. The mixing unit according to claim 1, wherein the concentrate for the ready-to use flushing solution includes ca. 443.6 g sorbitol, ca. 88.7 g mannitol and ca. 648.7 g water per liter concentrate volume.

9. The mixing unit according to claim 1, wherein a concentration factor of the concentrate for the ready-to-use flushing solution is 16 to 17, whereby the concentrate remains without precipitation at low temperatures of ca. 5° C.

* * * * *